US008113633B2

(12) United States Patent
Hirasawa et al.

(10) Patent No.: US 8,113,633 B2
(45) Date of Patent: Feb. 14, 2012

(54) LIQUID EJECTING HEAD AND LIQUID EJECTING APPARATUS HAVING SAME

(75) Inventors: Yusuke Hirasawa, Minowa-machi (JP); Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 507 days.

(21) Appl. No.: 12/361,895

(22) Filed: Jan. 29, 2009

(65) Prior Publication Data

US 2009/0195606 A1 Aug. 6, 2009

(30) Foreign Application Priority Data

Jan. 31, 2008 (JP) ..... 2008-020356
Apr. 28, 2008 (JP) ..... 2008-116677

(51) Int. Cl.
*B41J 2/045* (2006.01)
*B41J 2/14* (2006.01)

(52) U.S. Cl. ..... 347/71; 347/47; 347/68

(58) Field of Classification Search ..... 347/47, 347/68–72; 29/25.35, 890.1; 156/60, 182, 156/250, 510

See application file for complete search history.

(56) References Cited

U.S. PATENT DOCUMENTS 5,670,999 A * 9/1997 Takeuchi et al. ..... 347/70

FOREIGN PATENT DOCUMENTS

| | | |
|---|---|---|
| JP | 06-297701 | 10/1994 |
| JP | 11-277743 | 10/1999 |
| JP | 2004-042559 | 2/2004 |

* cited by examiner

*Primary Examiner* — Geoffrey Mruk
(74) *Attorney, Agent, or Firm* — Workman Nydegger

(57) ABSTRACT

A liquid ejecting head includes a passage unit made by laminating a plurality of plates including a first plate having a first through-hole with a first size and a second plate having a second through-hole with a second size which is larger than the first size. The first plate and the second plate are bonded with adhesive so that the first through-hole and the second through-hole in communication with each other. The affinity for the adhesive to bond to the inner peripheral surface of the second through-hole is set to be at least higher than the affinity for the adhesive to bond to the area around the opening of the first through-hole. Adhesive that flows out from between the first plate and the second plate at the time of bonding of the first plate and the second plate is guided to the inner peripheral surface of the second through-hole.

10 Claims, 5 Drawing Sheets

LIQUID EJECTING HEAD AND LIQUID EJECTING APPARATUS HAVING SAME

BACKGROUND OF THE INVENTION

The entire disclosures of Japanese Patent Application Nos. 2008-020356, filed Jan. 31, 2008, 2008-116677, filed Apr. 28, 2008, are expressly incorporated herein by reference.

1. Technical Field

The present invention relates to a liquid ejecting head, such as an ink jet recording head, and a liquid ejecting apparatus. More specifically, the present invention relates to a liquid ejecting head having an improved ability to discharge air bubbles in the liquid ejecting head, and a liquid ejecting apparatus having the same.

2. Related Art

Examples of liquid ejecting heads currently known in the art that eject or discharge liquid from a nozzle orifice by fluctuating the pressure of the liquid in a pressure chamber include, for example, an ink jet recording head (hereinafter referred to as a recording head) used in an image recording apparatus such as an ink jet recording apparatus (hereinafter referred to as printer), a color material ejecting head used for manufacturing color filters of liquid crystal displays or the like, an electrode material ejecting head used for forming electrodes of organic EL (electroluminescence) displays, FEDs or field emission displays, or the like, and a bioorganic matter ejecting head used for manufacturing biochips (biochemical elements).

The above recording head is made by laminating a plurality of components. For example, a recording head disclosed in Japanese Patent Application No. JP-A-11-277743 includes an actuator unit serving as a pressure generator, a pressure chamber unit that forms a plurality of pressure chambers, and a passage unit that forms a plurality of liquid passages. The actuator unit and pressure chamber unit, and passage unit are then laminated and integrated.

The pressure chamber unit is made by laminating a pressure chamber plate or spacer having a plurality of pressure generating chambers formed therein, a communication port plate or second cover having nozzle communication ports and supply side communication ports formed therein, and a vibrating plate or first cover on which piezoelectric vibrators are mounted. The components are then integrated into a single component using a process such as, for example, firing. The passage unit is made by laminating a number of plate members, including a supply port plate or ink supply port forming substrate having supply ports formed therein, a reservoir forming substrate having reservoirs or common liquid chambers formed therein, and a nozzle plate in which a plurality of nozzle orifices are arranged in lines in order to form rows of nozzles. The plate members are then bonded together with adhesive so as to integrate them into a single component. When ink is ejected by the recording head, a pressure chamber is preliminarily expanded before ink is ejected, creating a vacuum. This causes the ink to be supplied from the corresponding reservoir via the corresponding supply port to the pressure chamber. Then, by rapidly contracting the pressure chamber after the preliminary expansion, ink is ejected from the corresponding nozzle orifice.

In the recording head having the above structure, it is most preferable that the ink passages inside the recording head be filled with ink. However, air can enter the ink passages when ink is initially filled in the recording head or when the ink cartridge is replaced. Moreover, outside air can pass through the walls of the recording head and generate air bubbles in the ink passages. It is difficult to completely prevent this. Once formed inside the ink passages, the air bubbles unite and produce larger bubbles. If such air bubbles stay in the ink passages, the air bubbles can absorb the pressure fluctuation at the time of the ejecting operation, causing a pressure loss. In addition, the air bubbles can block the passages, thereby causing an inadequate supply of ink to the recording head.

To prevent problems caused by air bubbles, various recovery operations are performed in the ink jet recording apparatus having the above recording head. For example, a cleaning operation may be performed to suck and discharge air bubbles and residual ink from the recording head through the nozzle orifices.

However, as shown in FIG. 5, when the adhesive A used to bond the plate members results in a recess in the inner wall surface of the ink passage 52, air bubbles B can form in the recess. Once air bubbles B enter this recess, it is difficult to remove the air bubbles, even when a cleaning operation is performed, so the above-described problems cannot be fixed. In contrast, when a larger amount of adhesive is used in the bonding process so that adhesive protrudes into the ink passage, the adhesive that extends into the ink passage can block any minute through-holes 53 such as the nozzle orifices and the supply ports.

BRIEF SUMMARY OF THE INVENTION

An advantage of some aspects of the invention is a liquid ejecting head capable of easily discharging air bubbles while preventing minute through-holes from being blocked by adhesive, and an accompanying liquid ejecting apparatus.

One aspect of the invention, is a liquid ejecting head including a passage unit made by laminating a plurality of plates including a first plate having a first through-hole and a second plate having a second through-hole, the second through-hole being larger than the first through-hole, wherein the first plate and the second plate are bonded together with an adhesive so that the first through-hole and the second through-hole are in communication with each other, where adhesive flows out between the first plate and the second plate during the bonding process and the affinity for the adhesive to adhere to the inner peripheral surface of the second through-hole is caused to be at least higher than the affinity for the adhesive to adhere around the opening of the first through-hole, so that the adhesive which flows out from between the first plate and the second plate during bonding is guided to the inner peripheral surface of the second through-hole.

According to the above configuration, the affinity for the adhesive of the inner peripheral surface of the second through-hole is set to be higher than the affinity for the adhesive of an area around the opening of the first through-hole, such that adhesive that flows out from between the first plate and the second plate at the time of bonding is guided to the inner peripheral surface of the second through-hole. Thus, the adhesive can be prevented from forming a recess in the inner peripheral surface of the passage between the first plate and the second plate. In addition, the adhesive can be prevented from flowing toward the first through-hole, which has a smaller diameter. As a result, the adhesive can be prevented from blocking the first through-hole, and the ease of discharging air bubbles can be improved.

Another aspect of the invention comprises a liquid ejecting apparatus which includes the liquid ejecting head described above. Another aspect of the invention is a liquid ejecting head comprising a first plate having a first through-hole, the area around the opening of the first through-hole having a first affinity for a liquid to adhere to the area, a second plate having a second through-hole, the second through-hole being larger than the first through-hole of the first plate, the inner peripheral surface of the second through-hole having a second affinity for a liquid to adhere to the inner peripheral surface, a third plate having a third affinity for a liquid to adhere to a surface of the third bond plate, a liquid adhesive capable of bonding the first plate and second plate so that the first through-hole and the second through-hole are in communication with each other, where adhesive flows out between the first plate and the second plate, the liquid adhesive being further capable of bonding the third plate to second plate on the surface of the second plate opposite to the surface bonded to the first plate. In the liquid ejecting head, the second affinity is higher than the first affinity and third affinity so that adhesive which flows out from between the first plate and the second plate and between the second plate and third plate during bonding is guided to the inner peripheral surface of the second through-hole.

BRIEF DESCRIPTION OF THE DRAWINGS

The invention will be described with reference to the accompanying drawings, wherein like numbers reference like elements.

DESCRIPTION OF EXEMPLARY EMBODIMENTS

The exemplary embodiments of the invention will now be described with reference to the drawings. In the following embodiments, various limitations are described as the preferred embodiments of the invention. However, the scope of the invention is not limited to these embodiments unless specifically specified in the following description.

In the following description, the liquid ejecting head is described using an ink jet recording head, hereinafter referred to as a recording head, mounted in an ink jet recording apparatus, as an example of a recording head and apparatus capable of performing aspects of the invention.

Figure 1:
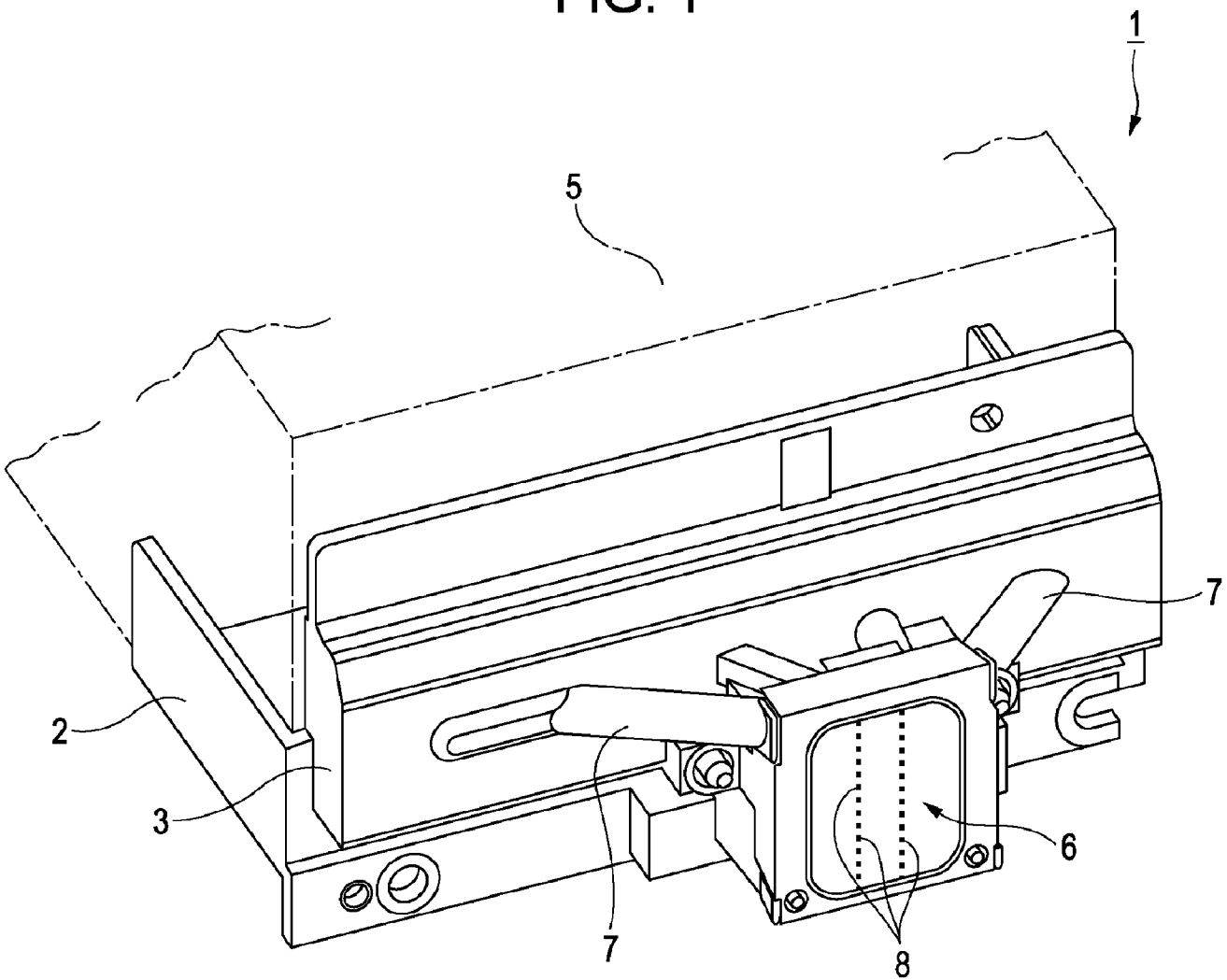
FIG. 1 is a perspective view of a head unit as viewed from the side of the nozzle plate.
Figure 2:
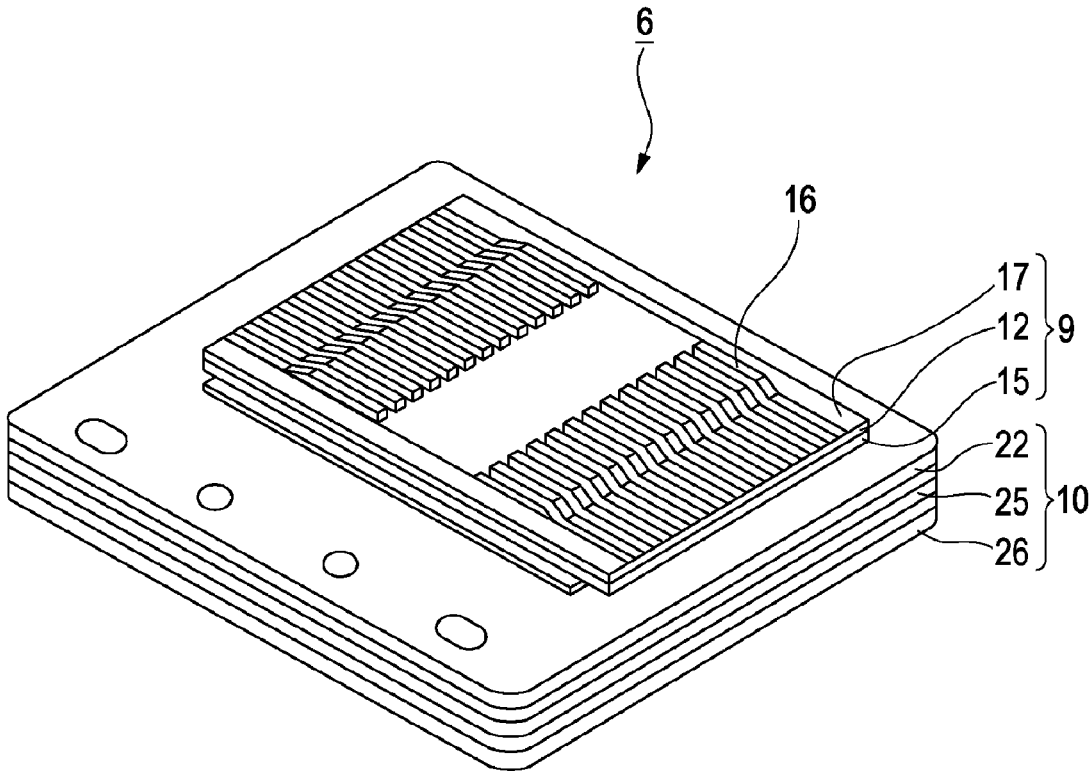
FIG. 2 is a perspective view of a recording head as viewed from the side of the pressure chamber unit.
Figure 3:
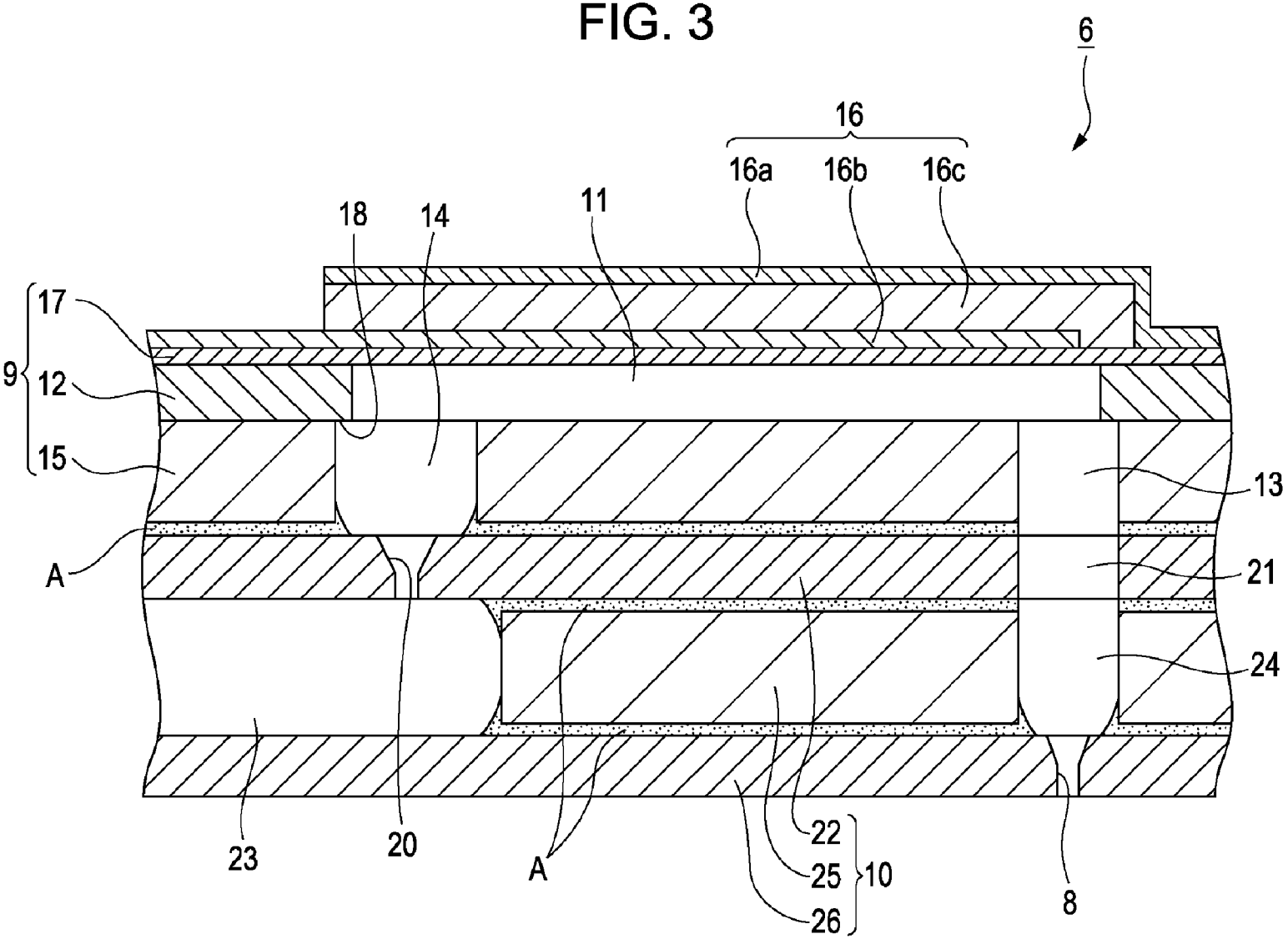
FIG. 3 is a sectional view of an essential part of the recording head.

FIG. 1 is a perspective view of a head unit 1 having a recording head 6 as viewed from the side of the nozzle plate of the recording head 6. FIG. 2 is a perspective view of the recording head 6 as viewed from the side of the piezoelectric vibrator. FIG. 3 is a sectional view of a component of the recording head 6.

As shown in FIG. 1, the head unit 1 has a carriage 2. On the upper surface of a base plate portion 3 of the carriage 2 a holder portion 5 is formed. A liquid supply source, such as an ink cartridge can be attached to the holder portion 5. A recording head 6 is attached to the bottom surface of the base plate portion 3 opposite from the holder portion 5. The recording head 6 and a liquid supply source held by the holder portion 5 are connected by ink supply passages 7. Thus, the recording head 6 is supplied with ink or other recording liquid via the ink supply passages 7. Although an ink cartridge is attached to a carriage 2 in this embodiment, it is also possible to attach an ink cartridge to a chassis of a printer and to supply ink to the recording head 6 via an ink supply tube, in an "off-carriage" configuration.

The ink supplied to the recording head 6 is discharged from a plurality of nozzle orifices 8 formed in the surface of the recording head 6. The nozzle orifices 8 are arranged in line at a pitch corresponding to the dot formation density. In this embodiment, two rows of nozzles are formed. The inside diameter of the nozzle orifices 8 in this embodiment is set to 20 μm.

As shown in FIGS. 2 and 3, the recording head 6 is composed of a pressure chamber unit 9, a passage unit 10, and piezoelectric vibrators 16, which are laminated and integrated into a single component. The pressure chamber unit 9 is made by laminating a pressure chamber plate 12 which defines pressure chambers 11, a communication port plate 15 having third communication ports 13 and supply side communication ports 14 formed therein, and a vibrating plate 17 on which the piezoelectric vibrators 16 are mounted. The plates are then integrated, for example, using a firing process. The passage unit 10 is made by the bonding plate members using an adhesive so that they are laminated. The plate members comprise a supply port plate 22 having supply ports 20 and second communication ports 21 formed therein, a reservoir plate 25 having reservoirs 23 and first communication ports 24 formed therein, and a nozzle plate 26 having nozzle orifices 8 formed therein.

The pressure chamber plate 12 comprises a thin plate of a ceramic material such as alumina or zirconia with a thickness suitable for forming pressure chambers. The pressure chamber plate 12 has openings for defining pressure chambers, the openings being formed through the plate in the thickness direction. The pressure chambers 11 are arranged in a line at the same regular pitch as the pitch of the nozzle orifices 8 of the nozzle plate 26. The pressure chambers 11 are holes which extend in a direction which is perpendicular to the direction in which the holes are aligned.

As with the pressure chamber plate 12, the communication port plate 15 comprises a thin plate of a ceramic material such as zirconia, in which third communication ports 13 and supply side communication ports 14 are formed. Each third communication port 13 is a through-hole that communicates with a corresponding pressure chamber 11 which is sufficiently larger than the nozzle orifice 8. Each third communication port 13 functions as a nozzle communication port together with corresponding second communication port 21 and first communication port 24 described more fully below. Each supply side communication port 14 is a circular hole that is formed through the thickness of the communication port plate 15 which communicates at one end with the corresponding pressure chamber 11 at the opposite end of the pressure chamber 11 from where the corresponding third communication port 13 is connected. Each supply side communication port 14 connects the corresponding reservoir 23 and the corresponding pressure chamber 11 together with the corresponding supply port 20. As shown in FIG. 3, each supply side communication port 14 is slightly offset from the end of the corresponding pressure chamber 11 in the longitudinal direction of the pressure chamber 11, and thereby a stepped portion 18 is formed between the pressure chamber 11 and the supply side communication port 14. This stepped portion 18 prevents the adhesive described below from entering the pressure chamber 11.

The vibrating plate 17 comprises a thin plate of a ceramic material having elasticity. A plurality of piezoelectric vibrators 16 corresponding to the pressure chambers 11 are disposed on the outer surface of the vibrating plate 17 on the opposite side from the pressure chamber 11. In this configuration, the piezoelectric vibrators 16 are vibrators of the bending vibration mode and include a drive electrode 16*a*, a common electrode 16*b*, and a piezoelectric body between the two electrodes 16*a* and 16*b*. When a drive signal is applied to the drive electrode 16*a* of a piezoelectric vibrator 16, an electric field is generated between the drive electrode 16*a* and the common electrode 16*b* according to the difference in electric potential between the two electrodes 16*a* and 16*b*. This electric field is applied to the piezoelectric body, and the piezoelectric body is deformed according to the strength of the applied electric field. That is, with the increase in the electric potential of the drive electrode 16*a*, the piezoelectric body layer contracts in a direction perpendicular to the electric field, thereby deforming the vibrating plate 17 so as to reduce the volume of the corresponding pressure chamber 11.

The supply port plate 22 of the passage unit 10 is a thin plate made of a metal material such as stainless steel. The supply port plate 22 has supply ports 20 formed through the thickness of the supply port plate 22 which correspond to the supply side communication ports 14, and second communication ports 21 formed through the thickness of the supply port plate 22 which correspond to the third communication ports 13. The second communication ports 21 are circular holes with the same diameter as the third communication ports 13. The supply ports 20 are minute through-holes with an inside diameter that is sufficiently smaller than the inside diameter of the supply side communication ports 14. Each supply port 20 is composed of a cylindrical straight portion and a tapered portion that tapers from the corresponding pressure chamber 11 toward the corresponding reservoir 23.

As with the supply port plate 22, the reservoir plate 25 comprises a metal plate such as stainless steel. The reservoir plate 25 has openings for defining the reservoirs 23, the openings being formed through the plate in the thickness direction. The reservoirs 23 function as common liquid chambers, and one reservoir 23 is provided for each color or kind of ink. The reservoir plate 25 has first communication ports 24 formed through the thickness thereof which correspond to the second communication ports 21.

The nozzle plate 26 is a thin plate-like member made of a metal material such as stainless steel. In the nozzle plate 26, a plurality of nozzle orifices 8 are arranged in a line, thereby forming rows of nozzles which form a kind of nozzle group. In this embodiment, one nozzle row consists of 180 nozzle orifices 8 arranged at a regular pitch, such as, for example, 180 dpi.

And adhesive A is used to bond the pressure chamber unit 9 and the supply port plate 22, the supply port plate 22 and the reservoir plate 25, and the reservoir plate 25 and the nozzle plate 26. Various adhesives known in the art may be used as the adhesive A, such as, for example, an epoxy resin adhesive or EVA (Ethylene-Vinyl Acetate) resin adhesive. Typically, the adhesive A is solid at ordinary temperature and is formed in a sheet. By disposing such sheets between the plate members and exerting pressure thereon in the direction in which the plate members are laminated while heating them with a heating tool, the adhesive A melts and thereafter hardens, bonding and integrating the plate members.

By integrating the plate members, as shown in FIG. 3, one end of each pressure chamber 11 is brought into communication with the corresponding reservoir 23 via the corresponding supply port 20 and the corresponding supply side communication port 14. In addition, the other end of each pressure chamber 11 is brought into communication with the corresponding nozzle orifice 8 via a nozzle communication port consisting of the corresponding first communication port 24 of the reservoir plate 25, the corresponding second communication port 21 of the supply port plate 22, and the corresponding third communication port 13 of the communication port plate 15. Thus, a continuous ink or liquid passage is formed which connects each nozzle orifice 8 to the corresponding reservoir 23 via the corresponding pressure chamber 11. In the recording head 6 having the above-described structure, by deforming a piezoelectric vibrator 16, the corresponding pressure chamber 11 contracts or expands, and pressure fluctuation occurs in the ink in the pressure chamber 11. By controlling this pressure, ink can be ejected from the corresponding nozzle orifice 8.

In this type of recording head, when the amount of adhesive A between the plate members is insufficient, the hardened adhesive includes a recess in the inner wall surface of the ink passage where air bubbles can enter the recording head. Once air bubbles enter this recess, it is difficult to remove the air bubbles, even when a cleaning operation is performed. In contrast, when a larger amount of adhesive is used so that the previously described recesses are prevented, the adhesive may protrude into the ink passage and block minute through-holes such as the nozzle orifice 8 and the supply port 20.

In view of such a problem, in the recording head 6 of the invention, the above problem is solved by adjusting the amount of adhesive so that adhesive flows out from between the plate members during the bonding process, with the excess adhesive being guided to a predetermined area. More specifically, the affinity of the adhesive to adhere to the inner peripheral surfaces of second through-holes is made to be higher than the affinity of the adhesive to adhere to the areas around the openings of first through-holes. The first through-holes are minute through-holes such as the nozzle orifices 8 or the supply ports 20. The second through-holes are through-holes that have a second inside diameter which is larger than a first inside diameter of the first through-holes. The second through-holes communicate with the first through-holes to constitute ink passages, that is, the first communication ports 24, the reservoirs 23, and the supply side communication ports 14. Thus, the adhesive A that flows out from between the plate members at the time of bonding of the plate members is actively guided to the inner peripheral surfaces of the second through-holes. In this configuration, the nozzle plate 26 and the supply port plate 22 comprise first plates as claimed in the invention, and the reservoir plate 25 and the communication port plate 15 comprise the second plates claimed in the invention.

Figure 4A:
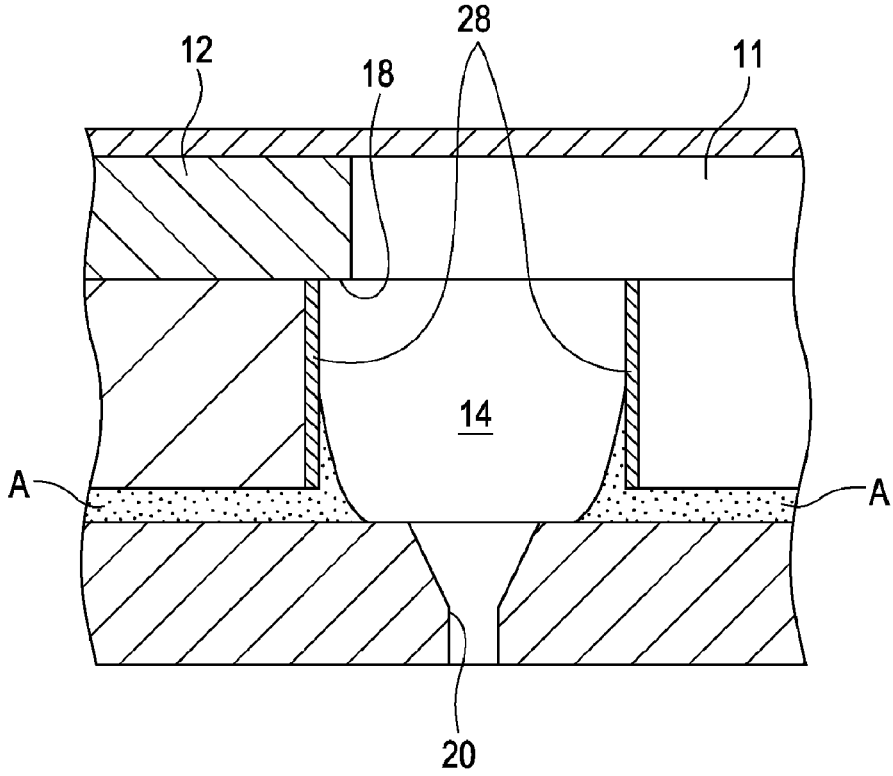
FIG. 4A is an enlarged sectional view illustrating the structure around a supply port and a supply side communication port.
Figure 4B:
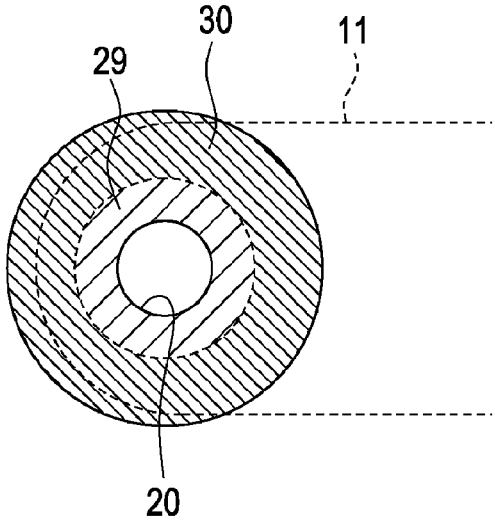
FIG. 4B is a plan view illustrating the structure around the supply port.
Figure 5:
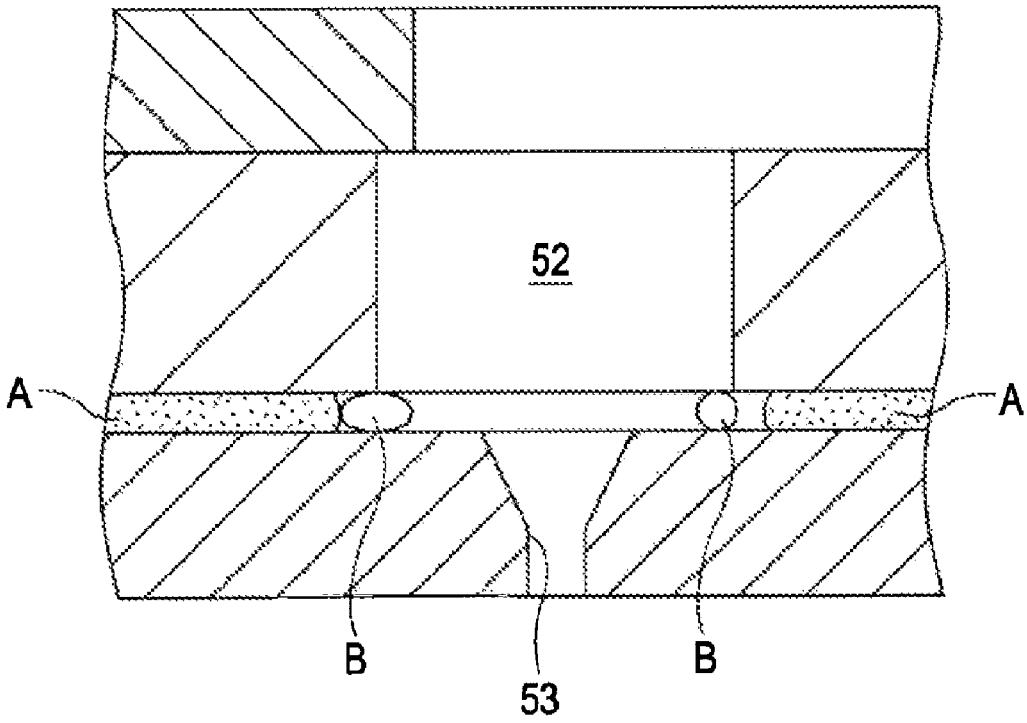
FIG. 5 (Prior Art)
FIG. 5 is a sectional view of a portion of a recording head known in the art.

The supply port 20 and the supply side communication port 14 will hereinafter serve as examples of the first through-hole and the second through-hole, respectively. When the nozzle orifice 8 is the first through-hole and the first communication port 24 is the second through-hole, and when the supply port 20 is the first through-hole and the reservoir 23 is the second through-hole, the description thereof is similar to the following, so it will be omitted. FIG. 4A is an enlarged sectional view illustrating the structure around a supply port 20 and a supply side communication port 14. FIG. 4B is a plan view illustrating the structure around the supply port 20. In this embodiment, the supply port plate 22 comprising a first plate and the communication port plate 15 comprising a second plate are both made of stainless steel. Thus, they have the same level of affinity for adhesive if no countermeasures are taken. By applying an agent that increases the affinity for liquid to adhere to the inner peripheral surface of the supply side communication port 14, a film 28 is formed on the surface of the supply side communication port 14 that increases the affinity of liquid to adhere to the surface. The affinity for the adhesive to adhere to the inner peripheral surface of the supply side communication port 14 is thereby made higher than the affinity for adhesive of the adhesive to adhere to the area around the opening of the supply port 20 on the surface of the supply port plate 22 bonded to the communication port plate 15. For example, polyvinylpyrrolidone (PVP) can be used as the agent that increases the affinity for liquid to adhere. The affinity for liquid to adhere can also be increased by coating the inner peripheral surface of the supply side communication port 14 with titanium dioxide and irradiating the coating film with ultraviolet.

As described above, by forming a film 28 that increases the affinity for liquid to adhere to the inner peripheral surface of the supply side communication port 14 communicating with the supply port 20, any adhesive A which flows out from between the supply port plate 22 and the communication port plate 15 when the plates are bonded is guided to the inner peripheral surface of the supply side communication port 14, which has a high affinity for liquid, and accumulates there. Thus, the adhesive A can be prevented from forming a recess in the inner peripheral surface of the passage between the supply port plate 22 and the communication port plate 15. In addition, the adhesive A can be prevented from flowing toward the supply port 20, which has a diameter smaller than that of the supply side communication port 14. Thus, the adhesive A can be prevented from blocking the supply port 20, and the ease of discharging air bubbles during a cleaning operation can be improved. In a printer having the above recording head 6, the efficiency of discharging air bubbles in the ink passages of the recording head 6 at the time of the cleaning operation is improved, so the amount of ink consumed in the cleaning operation can be reduced.

In this embodiment, as shown in FIG. 4B, the affinity for adhesive in a first region 29 around the opening of the supply port 20 has a lower affinity for the adhesive adhering than a second region 30 around the first region. In other words, by increasing the affinity for liquid of the second region 30, the affinity for adhesive of the second region 30 is made higher than the affinity for adhering of the first region 29. The first region 29 is a region having a width of about half the distance between the edge of the opening of the supply port 20 to the inner peripheral surface of the supply side communication port 14. The second region 30 is a region has a similar range and is formed outside the first region 29. The affinity for adhesive of the inner peripheral surface of the supply side communication port 14 is higher than the affinity for adhesive of the second region 30. That is, the affinity for liquid increases in the order of the first region 29, the second region 30, and the inner peripheral surface of the supply side communication port 14.

As described above, by making the affinity for adhesive of the second region 30 higher than the affinity for adhesive of the first region 29, the adhesive A can easily flow out from between the supply port plate 22 and the communication port plate 15, and the adhesive A that flows out can be actively guided to the inner peripheral surface of the supply side communication port 14. In addition, the adhesive A that flows out can be kept at least within the second region 30, and the supply port 20 can be prevented from being blocked by the adhesive A. Since the affinity for adhesive increases in the order of the first region 29, the second region 30, and the inner peripheral surface of the supply side communication port 14, the adhesive A adheres to the second region 30 and the inner peripheral surface of the supply side communication port 14, forming a slope. Thus, ink and air bubbles can smoothly flow through the supply side communication port 14, and the ease of discharging air bubbles can be further improved. In a printer having such a recording head 6, the efficiency of discharging air bubbles in the ink passages during a cleaning operation is improved, so the amount of ink consumed in the cleaning operation can be reduced.

In addition, in this embodiment, the pressure chamber plate 12, comprising a third plate in the claims below, is bonded to the communication port plate 15 opposite to the supply port plate 22. The surface of the pressure chamber plate 12 bonded to the communication port plate 15 has a lower affinity for adhesive than the inner peripheral surface of the supply side communication port 14. More specifically, the stepped portion 18 near the end of the pressure chamber 11 that communicates with the supply side communication port 14 has a lower affinity for adhesive than the inner peripheral surface of the supply side communication port 14. Thus, the adhesive A can be kept on the inner peripheral surface of the supply side communication port 14, which has the highest affinity, and the adhesive A can be prevented from excessively flowing toward the pressure chamber 11. Methods for reducing the affinity for adhesive include applying a fluorine-based liquid-repellent agent.

In the above embodiment, by forming a film 28 that increases the affinity for adhering liquid on the inner peripheral surface of the second through-hole, the affinity for adhesive of the inner peripheral surface of the second through-hole is made higher than the affinity for adhesive of an area around the first through-hole. However, the invention is not limited to this. For example, the second plates (that is, the communication port plate 15 and the reservoir plate 25) may be made of a material having a higher affinity for adhesive than the material of the first plates (that is, the supply port plate 22 and the nozzle plate 26). In this case, the same advantageous effects as those of the above first embodiment can be obtained.

In the above embodiments, a recording head 6 mounted in a printer which serves as an example of a liquid ejecting head where aspects of the invention may be performed. However, the invention can also be applied to other liquid ejecting heads made by bonding a plurality of plate members with adhesive. The invention can also be applied, for example, to a color material ejecting head used for manufacturing color filters of liquid crystal displays or the like, an electrode material ejecting head used for forming electrodes of organic EL (electroluminescence) displays, FEDs (field emission displays), and a bioorganic matter ejecting head used for manufacturing biochips (biochemical elements).

What is claimed is:

1. A liquid ejecting head comprising:

a passage unit made by laminating a plurality of plates including a first plate having a first through-hole and a second plate having a second through-hole, the second through-hole being larger than the first through-hole, wherein the first plate and the second plate are bonded together with an adhesive so that the first through-hole and the second through-hole are in communication with each other, where adhesive flows out between the first plate and the second plate during the bonding process and the affinity for the adhesive to adhere to the inner peripheral surface of the second through-hole is caused to be at least higher than the affinity for the adhesive to adhere around the opening of the first through-hole, so that the adhesive which flows out from between the first plate and the second plate during bonding is guided to the inner peripheral surface of the second through-hole, wherein the inner peripheral surface of the second through-hole is coated with a film that increases the affinity for the adhesive to adhere to the inner peripheral surface of the second through-hole.

2. The liquid ejecting head according to claim 1, wherein the affinity for the adhesive to adhere to a first region around the opening of the first through-hole is lower than the affinity for the adhesive to adhere to a second region around the first region.

3. The liquid ejecting head according to claim 2, wherein the affinity for the adhesive to adhere to the inner peripheral surface of the second through-hole is higher than the affinity for the adhesive to adhere to the second region.

4. The liquid ejecting head according to claim 1, further comprising a third plate bonded to the second plate on the surface of the second plate opposite to the surface bonded to the first plate, and wherein the affinity for the adhesive to adhere to the surface of the third plate is lower than the affinity for the adhesive to adhere to the inner peripheral surface of the second through-hole.

5. A liquid ejecting apparatus comprising the liquid ejecting head according to claim 1.

6. A liquid ejecting head comprising:

a passage unit made by laminating a plurality of plates including a first plate having a first through-hole and a second plate having a second through-hole, the second through-hole being larger than the first through-hole, wherein the first plate and the second plate are bonded together with an adhesive so that the first through-hole and the second through-hole are in communication with each other, where adhesive flows out between the first plate and the second plate during the bonding process and the affinity for the adhesive to adhere to the inner peripheral surface of the second through-hole is caused to be at least higher than the affinity for the adhesive to adhere around the opening of the first through-hole, so that the adhesive which flows out from between the first plate and the second plate during bonding is guided to the inner peripheral surface of the second through-hole, wherein the second plate is made of a material having an affinity for the adhesive to adhere to the second plate which is higher than the affinity of the material of the first plate.

7. A liquid ejecting head comprising:

a first plate having a first through-hole, the area around the opening of the first through-hole having a first affinity for a liquid to adhere to the area;

a second plate having a second through-hole, the second through-hole being larger than the first through-hole of the first plate, the inner peripheral surface of the second through-hole having a second affinity for a liquid to adhere to the inner peripheral surface;

a third plate having a third affinity for a liquid to adhere to a surface of the third bond plate;

a liquid adhesive capable of bonding the first plate and second plate so that the first through-hole and the second through-hole are in communication with each other, where adhesive flows out between the first plate and the second plate, the liquid adhesive being further capable of bonding the third plate to second plate on the surface of the second plate opposite to the surface bonded to the first plate;

wherein the second affinity is higher than the first affinity and third affinity so that adhesive which flows out from between the first plate and the second plate and between the second plate and third plate during bonding is guided to the inner peripheral surface of the second through-hole, wherein the inner peripheral surface of the second through-hole is coated with a film that increases the affinity for the adhesive to adhere to the inner peripheral surface of the second through-hole.

8. The liquid ejecting head according to claim 7, wherein the affinity for the adhesive to adhere to a first region around the opening of the first through-hole is lower than the affinity for the adhesive to adhere to a second region around the first region.

9. The liquid ejecting head according to claim 8, wherein the second affinity is higher than the affinity for the adhesive to adhere to the second region.

10. A liquid ejecting head comprising:

a first plate having a first through-hole, the area around the opening of the first through-hole having a first affinity for a liquid to adhere to the area;

a second plate having a second through-hole, the second through-hole being larger than the first through-hole of the first plate, the inner peripheral surface of the second through-hole having a second affinity for a liquid to adhere to the inner peripheral surface;

a third plate having a third affinity for a liquid to adhere to a surface of the third bond plate;

a liquid adhesive capable of bonding the first plate and second plate so that the first through-hole and the second through-hole are in communication with each other, where adhesive flows out between the first plate and the second plate, the liquid adhesive being further capable of bonding the third plate to second plate on the surface of the second plate opposite to the surface bonded to the first plate;

wherein the second affinity is higher than the first affinity and third affinity so that adhesive which flows out from between the first plate and the second plate and between the second plate and third plate during bonding is guided to the inner peripheral surface of the second through-hole, wherein the second plate is made of a material having an affinity for the adhesive to adhere to the second plate which is higher than the affinity of the material of the first plate.

* * * * *